US010943777B1

(12) United States Patent
Smith

(10) Patent No.: US 10,943,777 B1
(45) Date of Patent: Mar. 9, 2021

(54) AMPLIFIER AMPLITUDE CONTROL FOR A MASS SPECTROMETER

(71) Applicant: Thermo Finnigan LLC, San Jose, CA (US)

(72) Inventor: Johnathan Wayne Smith, Round Rock, TX (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 16/664,538

(22) Filed: Oct. 25, 2019

(51) Int. Cl.

| | |
|---|---|
| ***H01J 49/36*** | (2006.01) |
| ***H01J 49/42*** | (2006.01) |
| ***H01J 49/00*** | (2006.01) |
| ***H01J 49/06*** | (2006.01) |

(52) U.S. Cl.
CPC ..... *H01J 49/36* (2013.01); *H01J 49/0031* (2013.01); *H01J 49/063* (2013.01); *H01J 49/4215* (2013.01)

(58) Field of Classification Search
CPC ..... H01J 49/36; H01J 49/0031; H01J 49/063; H01J 49/4215
See application file for complete search history.

(56) References Cited

U.S. PATENT DOCUMENTS

| | | | |
|---|---|---|---|
| 3,735,287 | A | 5/1973 | Lowe |
| 8,957,391 | B2 | 2/2015 | Kholomeev |
| 10,236,788 | B2 | 3/2019 | Wohlgethan |
| 10,284,154 | B1 | 5/2019 | Schoessow |
| 2011/0278917 | A1 | 11/2011 | Vandermey et al. |

FOREIGN PATENT DOCUMENTS

| | | | |
|---|---|---|---|
| JP | 2014022162 | A | 2/2014 |
| WO | WO-2012082909 | A2 | 6/2012 |

OTHER PUBLICATIONS

Guo, et al., "A radio frequency signal driver for quadrupole used in desktop orthogonal-injection time-of-flight mass spectrometer", Nuclear Instruments and Methods in Physics Research A, vol. 694, Dec. 2012, pp. 255-262.

Jones, et al., "Simple radio-frequency power source for ion guides and ion traps", Review of Scientific Instruments, vol. 68, No. 9, Sep. 1997, pp. 3357-3362.

*Primary Examiner* — Nicole M Ippolito
*Assistant Examiner* — Hanway Chang

(57) ABSTRACT

Control of an amplitude of a signal applied to rods of a quadrupole is described. In one aspect, a mass spectrometer includes a quadrupole mass analyzer and a resonant circuit to generate a radio frequency (RF) signal applied to rods of the quadrupole mass analyzer. An amplitude control circuit can be inductively coupled with inductors of the resonant circuit to selectively discharge energy from the resonant circuit and, therefore, adjust the amplitude of the signal in particular situations.

20 Claims, 8 Drawing Sheets

AMPLIFIER AMPLITUDE CONTROL FOR A MASS SPECTROMETER

TECHNICAL FIELD

This disclosure relates to mass spectrometry, and more particularly to controlling an amplitude of a radio frequency (RF) signal of a RF amplifier applied to mass analyzers, ion guides, and ion traps of a mass spectrometer.

BACKGROUND

Mass spectrometry is an analytical technique used to measure the mass-to-charge ratios (m/z) of ions. Typically, a sample is introduced into an ion source of the mass spectrometer to be ionized. The resulting ions are then subject to transport, confinement, and separation by various components of the mass spectrometer. Typically, radio frequency (RF) signals, as well as direct current (DC) offset voltages, are applied to electrodes of the components to generate electric fields used to manipulate the ions for transport, confinement, and separation.

For example, some mass spectrometers use a quadrupole mass filter, a set of four parallel rods, as a mass analyzer to separate the ions according to their m/z. Two of the four rods of the quadrupole are applied a first oscillating RF signal, and the other two rods are applied another oscillating RF signal that is 180° out-of-phase from the first RF signal. The application of the RF signals, together with a resolving DC voltage applied in opposite polarities to the rod pairs, generates an oscillating electric field that causes the transmission of selected ions through the quadrupole based on the m/z ratios of the ions, amplitudes of the RF and resolving DC signals, and the frequency of the RF signals.

An RF amplifier circuit can generate the RF signal with an amplitude in the thousands of volts used to generate the oscillating electric field to resolve larger masses. The slew rate, or the time that the RF amplifier circuit responds to an input signal to generate the RF signal, and the power efficiency of the RF amplifier circuit are balanced together, but usually results in some performance loss. To avoid this, the RF amplifier circuit can be operated in a non-linear fashion, or overdriven, to reduce the power used to achieve a steady-state RF signal. This results in shorter settling times and higher efficiency. Unfortunately, overdriving an RF amplifier circuit often causes ringing on the RF signal (i.e., unwanted oscillations as the RF signal changes) and overshooting the desired settling point of the RF signal without appropriate drive control. Thus, the performance of the mass spectrometer is degraded.

SUMMARY

One innovative aspect of the subject matter described in this disclosure includes a mass spectrometer including a quadrupole mass analyzer; a resonant circuit configured to generate a first radio frequency (RF) signal applied to a first pair of rods of the quadrupole mass analyzer, the resonant circuit having a first resonant inductor used to store energy for generating the first RF signal at a first amplitude; an amplitude control circuit having a first amplitude control inductor that is inductively coupled with the first resonant inductor, and having a first diode that is coupled with the first amplitude control inductor; and a controller circuit configured to transfer energy from the first resonant inductor to the first amplitude control inductor to adjust the first RF signal from the first amplitude to a second amplitude by changing an operational state of the first diode.

In some implementations, the first resonant inductor has a higher inductance than the first amplitude control inductor.

In some implementations, the operational state of the first diode is changed from being in a reverse bias mode of operation to a forward bias mode of operation.

In some implementations, the quadrupole mass analyzer includes a second pair of rods, the resonant circuit is configured to generate a second RF signal applied to the second pair of rods, the resonant circuit having a second resonant inductor used to store energy for generating the second RF signal at the first amplitude, wherein the amplitude control circuit includes a second amplitude control inductor that is inductively coupled with the second resonant inductor, and having a second diode that is coupled with the second amplitude control inductor, and wherein the controller circuit is configured to transfer energy from the second resonant inductor to the second amplitude control inductor to adjust the second RF signal from the first amplitude to the second amplitude by changing an operational state of the second diode.

In some implementations, a cathode of the first diode is coupled with a cathode of the second diode to define a cathode node, and wherein the controller circuit is configured to bias the cathode node to change the operational state of one or both of the first diode or the second diode.

In some implementations, the amplitude control circuit further includes a switch, and the controller circuit is further configured to operate the switch to bias a cathode of the first diode to change the operational state.

In some implementations, the controller is further configured to determine a bleed down time representative of a time for adjusting the first RF signal from the first amplitude to the second amplitude, and configured to operate the switch to bias the cathode of the first diode for the bleed down time.

In some implementations, the first resonant inductor and the first amplitude control inductor are air core coils.

In some implementations, the first amplitude control inductor includes one or more coils that are wound around coils of the first resonant inductor.

In some implementations, the resonant circuit is defined by an inductance of the first resonant inductor and a capacitance of the first pair of rods of the quadrupole mass analyzer.

In some implementations, the first diode is a Schottky diode.

Another innovative aspect of the subject matter described in this disclosure includes an apparatus including a quadrupole configured to manipulate ions by generating an oscillating electric field; a resonant circuit configured to store energy using a first resonant inductor and use the energy to generate a signal applied to the quadrupole to generate the electric field; and an amplitude control circuit configured to transfer energy from the first resonant inductor using a first amplitude control inductor to adjust an amplitude of the signal applied to the quadrupole.

In some implementations, the amplitude control circuit includes a first diode having an anode coupled with the first amplitude control inductor.

In some implementations, the apparatus includes a controller circuit configured to bias a cathode of the first diode to transfer the energy away from the first resonant inductor to reduce the amplitude of the signal.

In some implementations, the diode is a Schottky diode.

In some implementations, the first resonant inductor has a higher inductance than the first amplitude control inductor.

Another innovative aspect of the subject matter described in this disclosure includes a method of operating a mass spectrometer, including: applying a voltage at a cathode of a diode; applying a radio frequency (RF) signal having a first amplitude to a quadrupole via a resonant circuit having a resonant circuit inductor; applying a voltage to an anode of the diode via inductive coupling of the resonant circuit and the anode of the diode; and discharging energy from the resonant circuit to adjust the first amplitude of the RF signal applied to the quadrupole to a second amplitude based on the inductive coupling and the voltages applied at the cathode and the anode of the diode.

In some implementations, the method includes: determining a bleed down time indicative of a time for adjusting the first amplitude of the RF signal to the second amplitude; and applying the voltage at the cathode of the diode in accordance with the bleed down time.

In some implementations, discharging the energy from the resonant circuit is based on changing an operational mode of the diode from a non-conductive state to a conductive-state based on the voltages applied to the cathode and the diode.

In some implementations, the diode is a Schottky diode.

DETAILED DESCRIPTION

Figure 1:
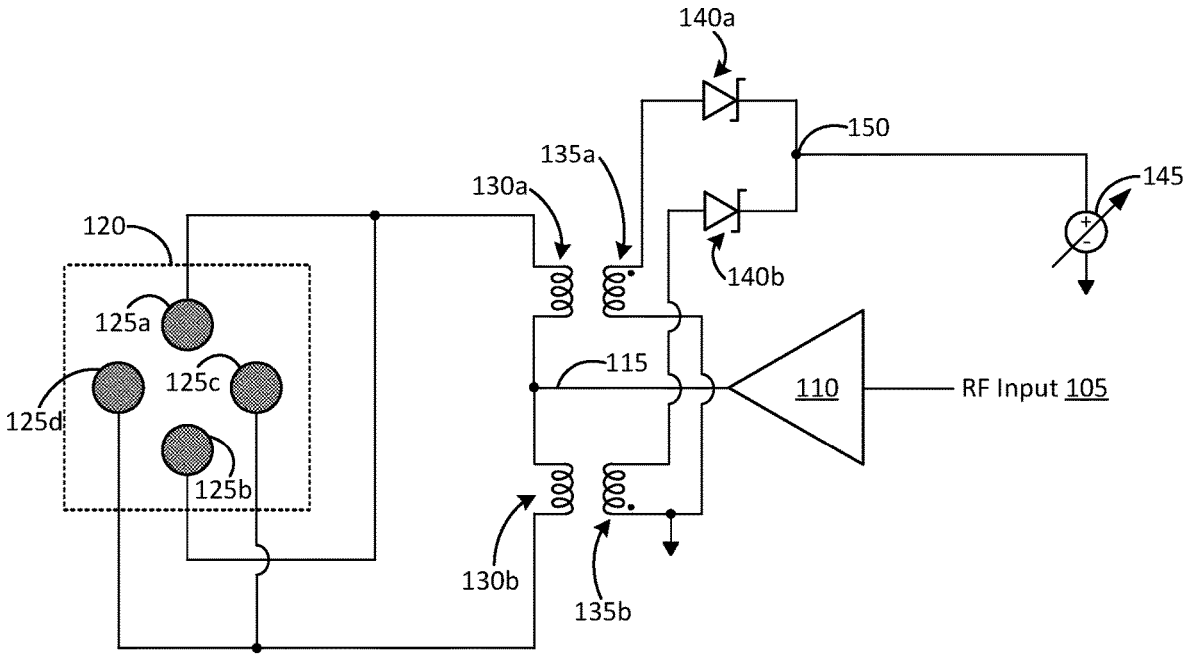
FIG. 1 illustrates an example of an amplitude control circuit for a radio frequency (RF) amplifier circuit.

Some of the material described in this disclosure includes circuits and techniques for controlling an amplitude of an output signal generated by an amplifier circuit for mass spectrometry. In one example, a mass spectrometer includes an ion source used to ionize an analyte. The resulting ions are then provided to a quadrupole mass analyzer for mass analysis. The quadrupole mass analyzer includes four parallel conductive (e.g., metallic) rods. In addition to direct current (DC) resolving voltages, two of the rods are applied a radio frequency (RF) signal that is 180° out-of-phase from an RF signal applied to the two other rods of the quadrupole. The RF signals applied to the rods oscillate within a peak-to-peak amplitude, resulting in an oscillating electric field used to manipulate the ions based on their mass-to-charge ratios (m/z).

These RF signals are generated by an RF amplifier circuit and can measure in the thousands of volts (V) during the oscillation (e.g., up to a peak-to-peak amplitude of 8000 V). The RF signals are applied to the rods via an LC circuit, or a resonant circuit, modeled to include an inductor and a capacitor coupled in series to function as a resonator to store energy, magnify the voltage, and oscillate at a specific frequency. The inductor may be implemented with the winding of an air core coil. The capacitor may be implemented with the capacitance of the rods of the quadrupole.

As previously discussed, the RF amplifier circuit can operate in an overdrive, or non-linear, mode to promote shorter settling times for the RF signal as well as increase the efficiency of the RF amplifier circuit. However, overdriving an RF amplifier circuit can result in ringing on the RF signal and overshooting the desired settling point for the RF signal, negatively affecting the performance of the mass spectrometer.

As described later in this disclosure, an amplitude control circuit is inductively coupled with the RF amplifier circuit and used to adjust the amplitude of the RF signal. For example, the amplitude control circuit includes low inductance coils that are inductively coupled with the coils of the resonant circuit of the RF amplifier circuit. The amplitude control circuit also includes Schottky diodes that are coupled in series with the low inductance coils and conductive upon a threshold voltage across their anodes and cathodes.

Due to the inductive coupling, the voltage at the anodes of the diodes changes as the voltage of the RF signal changes during its oscillation due to the RF signal being applied to the inductors of the resonant circuit. A voltage at the cathodes of the diodes can be established such that the diodes are conductive when the voltage at the anodes reaches a threshold voltage (e.g., above the desired amplitude for the RF signal), causing a short to the voltage source at the cathodes. This results in a limitation to (or control of) the voltage of the RF signal because, due to the inductive coupling, energy is discharged from the resonant circuit (e.g., from the magnetic field generated by the inductors) upon the threshold voltage being reached as the RF signal oscillates.

This effectively limits the voltage of the RF signals applied to the quadrupoles and, therefore, limits the amplitude of the RF signals to within a smaller peak-to-peak amplitude range. Thus, ringing and overshooting of the RF signals are avoided or reduced and, therefore, the performance of the mass spectrometer is improved.

Additionally, the voltage of the RF signal can be rapidly adjusted from a higher voltage to a lower voltage by controlling the voltage at the cathodes to reduce the amplitude of the RF signal. This allows the mass analyzer to quickly establish the proper electric field to separate the appropriate ions in accordance with their m/z. Thus, the throughput of the mass spectrometer is improved, allowing more data to be collected.

Figure 2:
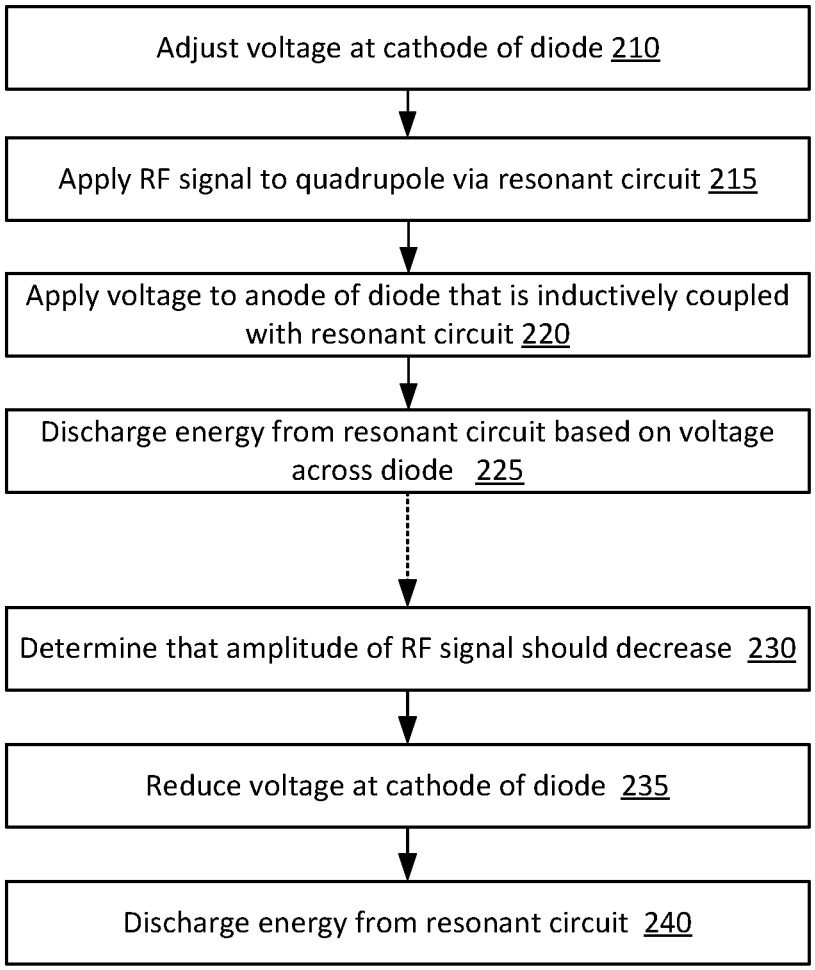
FIG. 2 illustrates an example of a block diagram for operating an amplitude control circuit for a RF amplifier circuit.

In more detail, FIG. 1 illustrates an example of an amplitude control circuit for a radio frequency (RF) amplifier circuit. FIG. 2 illustrates an example of a block diagram for operating the amplitude control circuit for the RF amplifier circuit in FIG. 1. In FIG. 2, a voltage at a cathode of a diode of an amplitude control circuit is adjusted (210). For example, in FIG. 1, variable voltage source 145 is controlled such that the voltage applied to cathode node 150, which is coupled to the cathodes of diodes 140*a* and 140*b*, is changed. As discussed in more detail later herein, the voltage applied to cathode node 150 can be selected to prevent overshooting or ringing of an RF signal generated and applied to quadrupole 120 in FIG. 1. For example, if the voltage across either of diodes 140*a* or 140*b* is above a threshold voltage, then the diode enters a forward bias condition (or "turned on") which allows conduction of current from the anode to the cathode. The conduction of the current reduces the energy stored in a resonant circuit that, in turn, causes the voltages corresponding to the peak-to-peak amplitude of the RF signals applied to rods of quadrupole 120 to be limited, as discussed below.

Returning to FIG. 2, a RF signal is generated and provided to a quadrupole via a resonant circuit (210). For example, in FIG. 1, RF amplifier 110 receives RF input 105, which is a signal that drives inputs of components of RF amplifier 110. In response, RF amplifier generates RF signal 115, which is a higher-power signal than RF input 105. RF signal 115 is provided to terminals of inductors 130*a* and 130*b* (both of which are out-of-phase with respect to the other such that inductors 130*a* and 130 provide out-of-phase signals to the corresponding rods). Inductor 130*a* is coupled with rods 125*a* and 125*b* of quadrupole 120, and inductor 130*b* is coupled with rods 125*c* and 125*d* of quadrupole 120. Resonant circuits are implemented via the inductances of the inductors and the capacitances of the rods (e.g., implementing a LC circuit) and, therefore, the voltage of RF signal 115 is magnified to provide out-of-phase signals, for example, up to 8000 V peak-to-peak amplitude to rods 125*a* and 125*b*, and rods 125*c* and 125*d* of quadrupole 120 to generate the appropriate electric fields to manipulate ions in accordance with their m/z.

Returning to FIG. 2, a voltage is applied to an anode of a diode that is inductively coupled with the resonant circuit (220). For example, in FIG. 1, inductors 135*a* and 135*b* of the amplitude control circuit are inductively coupled with inductors 130*a* and 130*b*, respectively, of the resonant circuit used by the RF amplifier circuit to provide RF signals to the rods of quadrupole 120. Inductors 130*a* and 130*b* can be relatively large air core coils. Inductors 135*a* and 135*b* can also be air core coils, but smaller in size and, therefore, substantially lower in inductance. For example, inductors 130*a* and 130*b* might each be 100-300 microhenry (pH) (e.g., both substantially the same value to maintain symmetry), and inductors 135*a* and 135*b* might each be 0.25 pH to 2 pH (e.g., both substantially the same value that is less than the value of inductors 130*a* and 130*b*).

Inductor 135*a* can be loops of coils, or wires, wound around the loops of coils of inductor 130*a*, such that they are in close physical proximity (e.g., disposed adjacent to each other, disposed along a same or similar axis, etc.) but not touching (and therefore not causing a physical short). For example, if inductors 135*a* and 135*b* are implemented with linear air core coils, then the coils can be between a range of one or two millimeters from each other, the spacing between the range determined based on the voltage breakdown gap for a setup of the RF amplifier and DC rod driver. Inductors 135*a* and 135*b* can also be positioned on the low voltage side of inductors 130*a* and 130*b*, respectively. This enables inductive coupling between inductors 130*a* and 135*b*. Thus, a voltage across inductor 130*a* induces a voltage across inductor 135*a*, for example, when RF signal 115 is applied to inductor 130*a*. The induced voltage is based on a variety of factors affecting the mutual inductance. A similar relationship also exists between inductor 130*b* and inductor 135*b*. Thus, an induced voltage is applied to the anode of diode 140*a* via the inductive coupling with inductor 135*a*, and an induced voltage is applied to the anode of diode 140*b* via the inductive coupling with inductor 135*b*.

Returning to FIG. 2, energy is then discharged from the resonant circuit based on the voltage across a diode (225). For example, in FIG. 1, voltages are being applied at the anodes and cathodes of diodes 140*a* and 140*b* of the amplitude control circuit. If the voltage across one of the diodes (as provided by the voltage at the anode from the mutual induction and the voltage applied to cathode node 150 from variable voltage source 145) is higher than the forward threshold voltage of the diode, then the diode enters a forward bias mode to allow conduction of current through. If the voltage across the diode is below the forward threshold voltage, then the conduction stops or is negligible (or eventually enters a reverse bias mode in other voltage conditions). Thus, the operational state of the diode can switch back-and-forth from the conductive, forward-bias mode and the non-conductive, reverse-bias mode.

In FIG. 1, diodes 140*a* and 140*b* can be Schottky diodes, though other types of diodes can also be implemented (e.g., a semiconductor diode implemented with a p-n junction). Schottky diodes include metal-semiconductor junctions with built-in potentials of approximately 0.15 V to 0.45 V. Thus, if the voltages across the anodes of either of diodes 140*a* and 140*b* and cathode node 150 are greater than the built-in potential, then the diode becomes conductive. This effectively creates a short using the mutual inductance between inductor 130*a* and inductor 135*a* to variable voltage source 145, or between inductor 130*b* to variable voltage source 145 and, therefore, energy "bleeds" from the resonant circuit to the amplitude control circuit. In turn, the voltage applied to the rods of quadrupole 120 reduces while diode is conductive, limiting the peak-to-peak amplitude of the RF signal applied to the rods.

When a threshold amount of energy is removed from the resonant circuit, and the voltage applied to the rods is reduced to a lower voltage from the removal of the energy, then the voltage applied at the anodes of diodes 140*a* and 140*b* is also reduced. When the voltage applied to the anodes is lowered to produce a voltage difference across the diode that is less than the built-in potential, then the diode turns "off" and is no longer conductive. Thus, any ringing or overshooting on RF signal 115 can be quickly compensated for by diodes 140*a* and 140*b* of the amplifier control circuit turning on when those conditions occur by selecting a voltage applied to cathode node 150 in view of the built-in potential of the diodes and the voltage desired to be applied to the rods of quadrupole 120.

The use of Schottky diodes for the amplitude control circuit can be advantageous due to the faster switching action and lower built-in potential compared to other types of diodes such as silicon diodes. Thus, using Schottky diodes can reduce the time taken to respond to the frequency of RF signal 115 generated by amplifier 110 as well as reducing the time taken to discharge energy from the resonant circuit, allowing the voltages applied to the quadrupoles to reach their expected levels faster and stay at the expected levels and, therefore, improving the throughput of the mass spectrometer.

Later, the mass spectrometer might perform mass analysis by using quadrupole 120 to target ions at a different m/z. This involves subjecting the ions to a different electric field. Thus, the voltages applied to rods 125*a-d* of quadrupole 120 should change. Often, the amplitude of the RF signal should be lower than the previously applied RF signal. The amplitude control circuit can be used in these situations to quickly adjust the amplitude applied to the rods of quadrupole 120.

Returning to FIG. 2, a determination can then be made that the peak-to-peak amplitude of the RF signal should decrease (230), the voltage at the cathode of a diode can be reduced (235), and energy is discharged from the resonant circuit (240). For example, in FIG. 1, the controller circuit of the mass spectrometer can determine that ions of a different m/z should be filtered using quadrupole 120, which is to be achieved by reducing the peak-to-peak amplitude of the RF signal applied to the rods. The voltage applied to cathode node 150 by variable voltage source 145 can be changed to be a lower voltage. This causes the voltages across the diodes 140*a* or 140*b* to increase and, therefore, the diodes can become conductive and energy is discharged from the resonant circuit due to the inductive coupling between the inductors, as previously discussed. Eventually, the voltages applied to the rods decrease due to the energy discharging (as well as any changes to RF input 105) until the diodes are non-conductive. Accordingly, the amplitude of the RF signal provided by the resonant circuit is reduced to the desired level based upon the selection of the voltage applied to cathode node 150.

The use of the amplitude control circuit allows faster selected reaction monitoring (SRM) and selective ion monitoring (SIM) scans due to establishing the electric fields faster by the quick adjustment of voltages to desired levels while also reducing or removing ringing and overshooting. Additionally, the RF amplifier circuit can operate with shorter settling times and higher efficiency.

Figure 3:
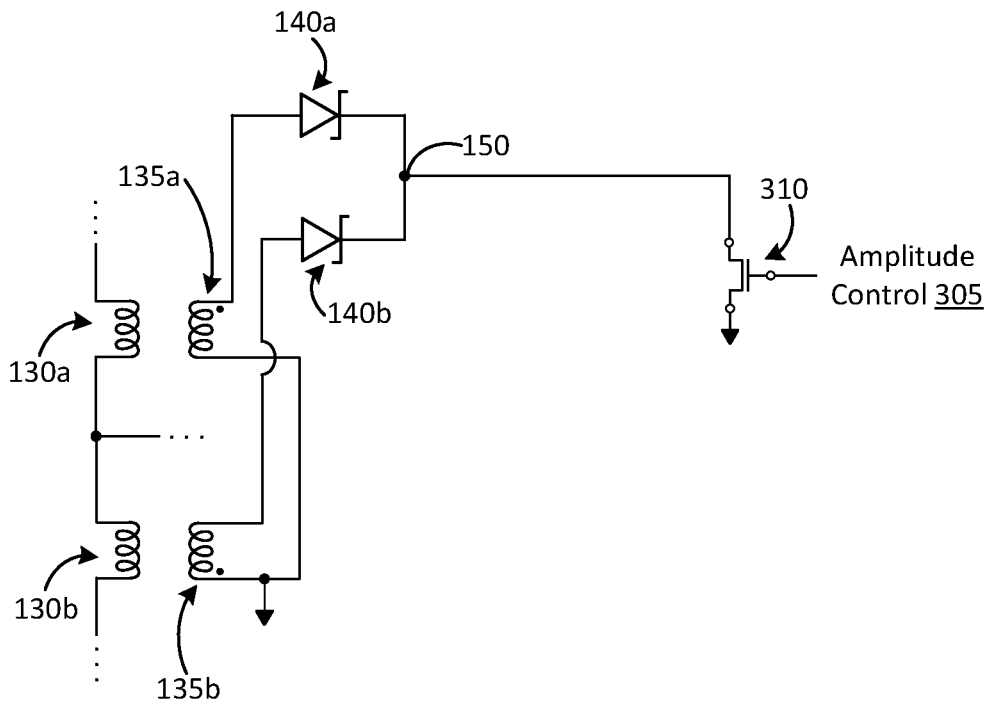
FIG. 3 illustrates another example of an amplitude control circuit for a RF amplifier circuit.

Applying a voltage to the cathode of the diodes of the amplitude control circuit can be performed using different techniques. FIG. 3 illustrates another example of an amplitude control circuit for a RF amplifier circuit. In FIG. 3, the amplitude control circuit is depicted with the use of transistor 310 (e.g., a metal-oxide-semiconductor field-effect transistor (MOSFET)) though other types of transistors or switches can be used. Transistor 310 includes a gate coupled to receive amplifier control 305. By asserting amplitude control 305, transistor 310 can turn on and create a short to ground (e.g., 0 V) though other power supply voltages can be used. As a result, the energy stored in the resonant circuit (partially depicted with inductors 130*a* and 130*b* in FIG. 3) begins to discharge as long as either of diodes 140*a* or 140*b* are turned on in a forward bias mode, which is the case when transistor 310 is turned on and a voltage above the built-in potential of the diodes is applied to their anodes. When the voltage across inductors 130*a* and 130*b* are at the expected level, amplitude control 305 can be de-asserted such that transistor 310 is no longer shorting cathode node 150 to ground. As a result, diodes 140*a* and 140*b* are no longer conductive. Thus, the voltages applied to the rods of quadrupole 120 in FIG. 1 are quickly changed to a lower voltage, reducing the peak-to-peak amplitude of the RF signal used by the rods to generate the electric field.

A controller circuit can determine when to assert amplitude control 305. For example, a lookup table (LUT) can be used to determine how long (e.g., in nanoseconds) that amplitude control 305 should be asserted to change the voltage across inductors 135*a* and 135*b* to from the higher voltage to the new lower voltage. This is a "bleed down" time used to remove energy from the resonant circuit such that the voltage range applied to the quadrupole rods is reduced (e.g., the peak-to-peak amplitude of the RF signal is reduced). Other implementations can determine the time to assert amplitude control 305 using an equation, a database storing the information, etc. The controller circuit can also be used to control variable voltage source 145 in FIG. 1.

Figure 4:
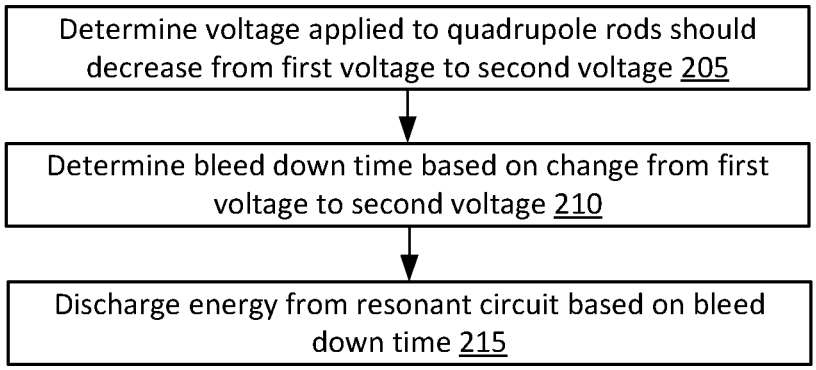
FIG. 4 illustrates an example of a block diagram for operating an amplitude control circuit for a RF amplifier circuit.

FIG. 4 illustrates an example of a block diagram for operating an amplitude control circuit for a RF amplifier circuit. In FIG. 4, the controller can determine that the voltage to be applied to the quadrupole rods should decrease from a first voltage to a second voltage (205). Next, the bleed down time based on the change from that first voltage to the second voltage is determined (210). Using the bleed down time, energy can be discharged from the resonant circuit (215). For example, in FIG. 3, transistor 310 can be turned on for a time duration of the bleed down time.

Figure 8:
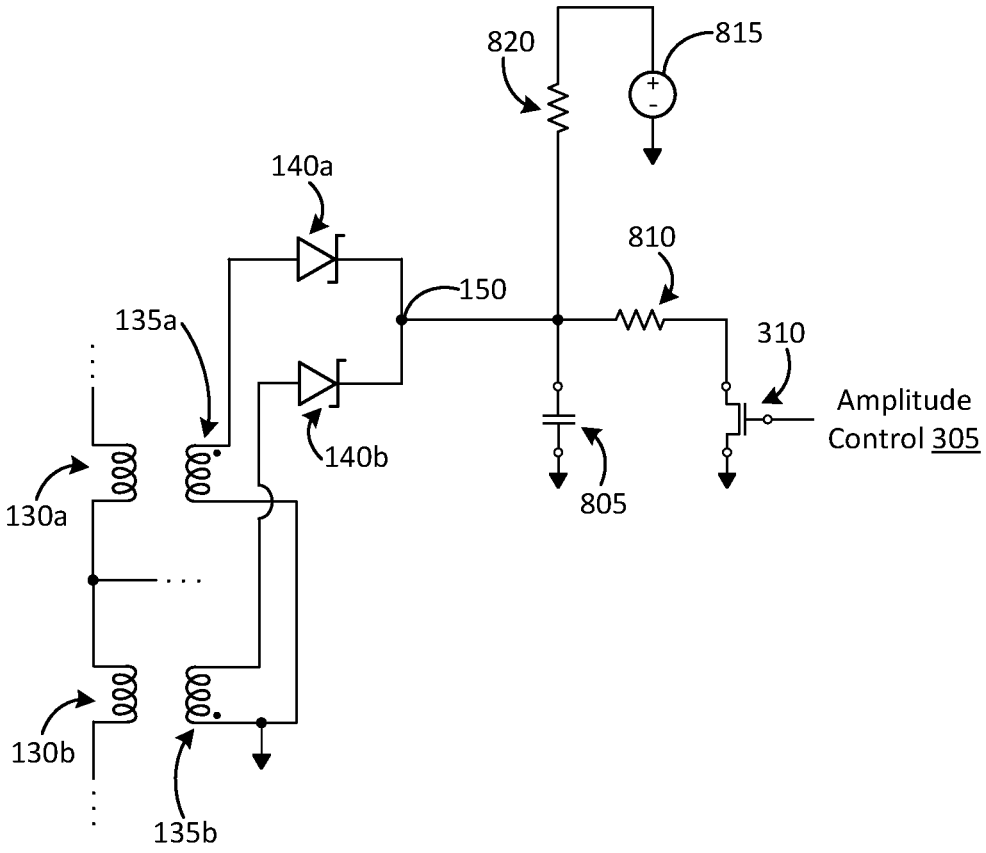
FIG. 8 illustrates another example of an amplitude control circuit for a RF amplifier circuit.

FIG. 8 illustrates another example of an amplitude control circuit for a RF amplifier circuit. In FIG. 8, capacitor 805, voltage source 815 (via resistor 820), and resistor 810 are coupled with cathode node 150. Resistor 810 can control the rate of energy removed from the resonant circuit based on a value of its resistance, thereby adding tenability to the amplitude control circuit. Capacitor 805, voltage source 815, and resistor 820 can hold the diodes in a state such that they are non-conductive. For example, as previously discussed, inductors 135*a* and 135*b* have an induced voltage from inductors 130*a* and 130*b*, respectively. In one example, resistor 810 is 1000 k Ohms, resistor 810 is 135 Ohms, and capacitor 805 is 500 picofarads.

By setting voltage source 815 to a voltage that is higher than a peak voltage induced on inductors 135*a* and 135*b*, diodes 140*a* and 140*b* would not clip the resonant circuit. This ensures that harmonics are not introduced into the resonant circuit during normal operation. In FIG. 8, resistor 820 is a power limiting resistor for voltage source 815. Resistor 820 and capacitor 805 define a time constraint that can be shorter than the maximum scan rate for amplifier 110 such that voltage source 815 is responsible for pulling up the voltage across the diodes rather than the resonant circuit during scanning.

Figure 5:
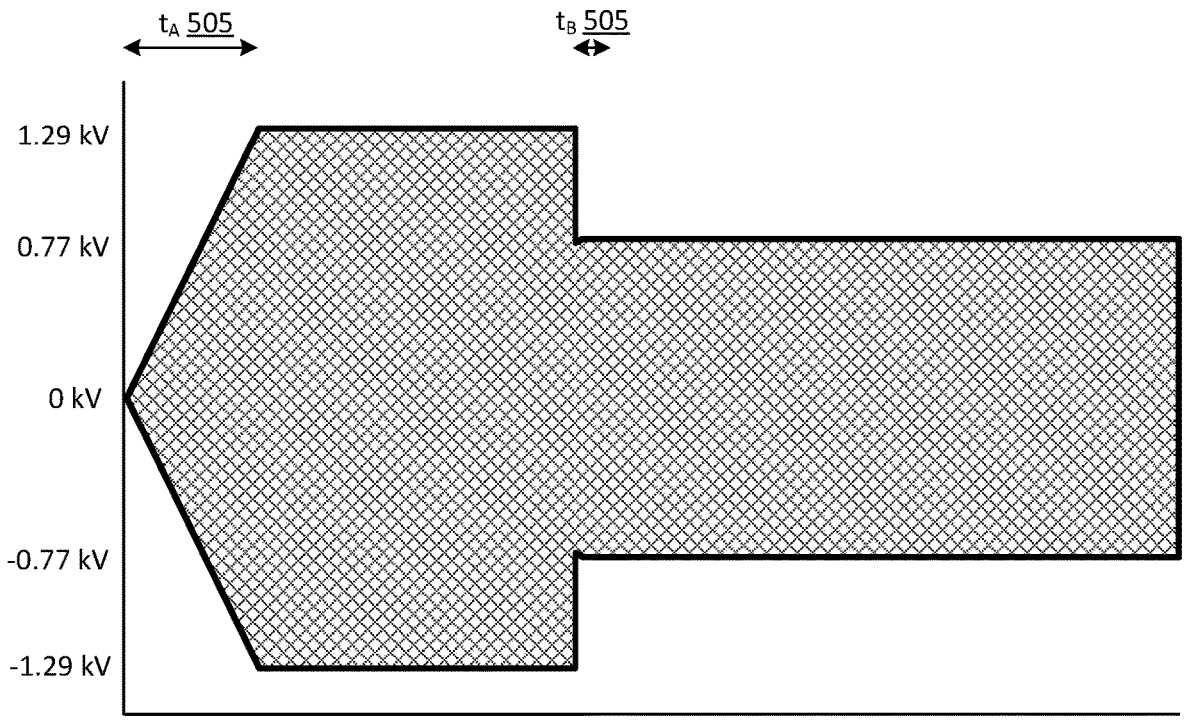
FIG. 5 illustrates an example of settling times and fall times of RF signals generated by an RF amplifier circuit.

Thus, in the aforementioned examples, the settling time when transitioning to a voltage is shortened. Moreover, the time to fall to a lower voltage is also shortened. FIG. 5 illustrates an example of settling times and fall times of RF signals generated by an RF amplifier circuit. In FIG. 5, $t_A$ 505 represents the settling time to rise from 0 V to 1.29 kilovolts (kV) or 0 V to −1.29 kV. When using the amplitude control circuit, $t_A$ 505 can be more than five times less than using the resonant circuit without the amplitude control circuit. For example, using the amplitude control circuit, $t_A$ 505 can be approximately 0.121 milliseconds (ms) while $t_A$ 505 can be between 0.6 ms to 0.8 ms when the amplitude control circuit is not used. When the voltage is reduced from 1.29 kV to 0.77 kV using the amplitude control circuit, time $t_B$ 505 to transition to the lower voltage is also performed quickly, for example, eight microseconds.

Figure 6:
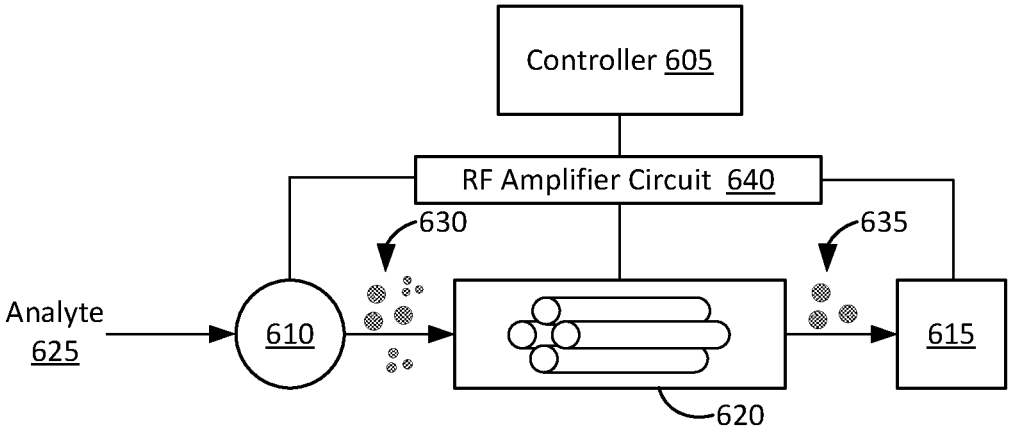
FIG. 6 illustrates an example of a mass spectrometer using an RF amplifier circuit.

FIG. 6 illustrates an example of a mass spectrometer using an RF amplifier circuit. In FIG. 6, a mass spectrometer includes ion source 610, quadrupole mass analyzer 620, detector 615, RF amplifier circuits 640, controller circuit 605. Controller circuit 605 includes or has access to memory storing instructions to perform the techniques described in the examples as well as any information used to perform the techniques. Power supply circuits 640 includes the circuitry described in the examples, including the resonant circuit, amplifier, and amplitude control circuit.

Ion source 610 receives analyte 625, for example, a peptide received from a separation device such as a liquid chromatography (LC) system and ionizes the received peptide to form ions. However, other types of analytes can be received and other separation techniques such as gas chromatography (GC) or capillary electrophoresis (CE) can also be used. The ions are then mass analyzed using mass analyzer 620 (e.g., a quadrupole). Detector 615 generates signals representative of m/z, which is interpreted by controller circuit 605 to generate or determine information that can be used to generate a mass spectrum. Other types of mass spectrometers such as tandem mass spectrometers can also be implemented.

Though quadrupole mass analyzers are described in the examples, other types of mass analyzers can be used with the techniques described herein. Additionally, other components of mass spectrometers that use RF signals, such as ion guides and ion traps, can also be used with the techniques described herein.

Figure 7:
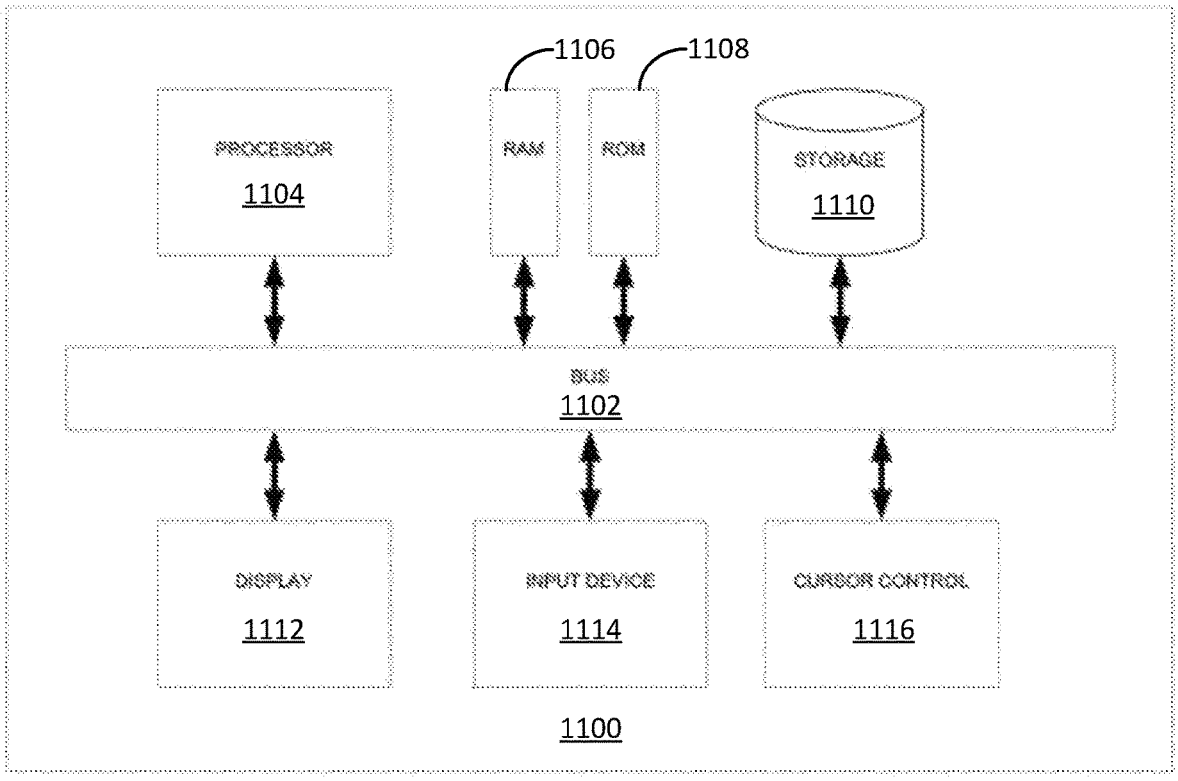
FIG. 7 illustrates an example of an electronic device which may be used to implement some of the examples.

FIG. 7 illustrates an example of an electronic device which may be used to implement some of the implementations. In some implementations, the electronic device of FIG. 7 can store or use a computer program product including one or more non-transitory computer-readable media having computer programs instructed stored therein, the computer program instructions being configured such that, when executed by one or more computing devices, the computer program instructions cause the one or more computing devices to perform the techniques described herein.

In FIG. 7, computer system 1100 can implement any of the methods or techniques described herein. For example, computer system 1100 can implement controller 605 in FIG. 6. Thus, the operation of components of the associated mass spectrometer may be adjusted in accordance with calculations or determinations made by computer system 1100. In various embodiments, computer system 1100 can include a bus 1102 or other communication mechanism for communicating information, and a processor 1104 coupled with bus 1102 for processing information. In various embodiments, computer system 1100 can also include a memory 1106, which can be a random access memory (RAM) or other dynamic storage device, coupled to bus 1102, and instructions to be executed by processor 1104. Memory 1106 also can be used for storing temporary variables or other intermediate information during execution of instructions to be executed by processor 1104. In various embodiments, computer system 1100 can further include a read only memory (ROM) 1108 or other static storage device coupled to bus 1102 for storing static information and instructions for processor 1104. A storage device 1110, such as a magnetic disk or optical disk, can be provided and coupled to bus 1102 for storing information and instructions.

In various embodiments, computer system 1100 can be coupled via bus 1102 to a display 1112, such as a cathode ray tube (CRT) or liquid crystal display (LCD), for displaying information to a computer user. An input device 1114, including alphanumeric and other keys, can be coupled to bus 1102 for communicating information and command selections to processor 1104. Another type of user input device is a cursor control 1116, such as a mouse, a trackball or cursor direction keys for communicating direction information and command selections to processor 1104 and for controlling cursor movement on display 1112. This input device typically has two degrees of freedom in two axes, a first axis (i.e., x) and a second axis (i.e., y), that allows the device to specify positions in a plane.

A computer system 1100 can perform the techniques described herein. Consistent with certain implementations, results can be provided by computer system 1100 in response to processor 1104 executing one or more sequences of one or more instructions contained in memory 1106. Such instructions can be read into memory 1106 from another computer-readable medium, such as storage device 1110. Execution of the sequences of instructions contained in memory 1106 can cause processor 1104 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations described herein are not limited to any specific combination of hardware circuitry and software.

The term "computer-readable medium" as used herein refers to any media that participates in providing instructions to processor 1104 for execution. Such a medium can take many forms, including but not limited to, non-volatile media, volatile media, and transmission media. Examples of non-volatile media can include, but are not limited to, optical or magnetic disks, such as storage device 1110. Examples of volatile media can include, but are not limited to, dynamic memory, such as memory 1106.

Examples of transmission media can include, but are not limited to, coaxial cables, copper wire, and fiber optics, including the wires that comprise bus 1102.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, etc.

While the techniques are described in conjunction with various implementations or embodiments, it is not intended that the techniques be limited to such embodiments. On the contrary, the techniques encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

I claim:

1. A mass spectrometer, comprising:

a quadrupole mass analyzer;

a resonant circuit configured to generate a first radio frequency (RF) signal applied to a first pair of rods of the quadrupole mass analyzer, the resonant circuit having a first resonant inductor used to store energy for generating the first RF signal at a first amplitude;

an amplitude control circuit having a first amplitude control inductor that is inductively coupled with the first resonant inductor, and having a first diode that is coupled with the first amplitude control inductor; and a controller circuit configured to transfer energy from the first resonant inductor to the first amplitude control inductor to adjust the first RF signal from the first amplitude to a second amplitude by changing an operational state of the first diode.

2. The mass spectrometer of claim 1, wherein the first resonant inductor has a higher inductance than the first amplitude control inductor.

3. The mass spectrometer of claim 1, wherein the operational state of the first diode is changed from being in a reverse bias mode of operation to a forward bias mode of operation.

4. The mass spectrometer of claim 1, wherein the quadrupole mass analyzer includes a second pair of rods, the resonant circuit is configured to generate a second RF signal applied to the second pair of rods, the resonant circuit having a second resonant inductor used to store energy for generating the second RF signal at the first amplitude, wherein the amplitude control circuit includes a second amplitude control inductor that is inductively coupled with the second resonant inductor, and having a second diode that is coupled with the second amplitude control inductor, and wherein the controller circuit is configured to transfer energy from the second resonant inductor to the second amplitude control inductor to adjust the second RF signal from the first amplitude to the second amplitude by changing an operational state of the second diode.

5. The mass spectrometer of claim 4, wherein a cathode of the first diode is coupled with a cathode of the second diode to define a cathode node, and wherein the controller circuit is configured to bias the cathode node to change the operational state of one or both of the first diode or the second diode.

6. The mass spectrometer of claim 1, wherein the amplitude control circuit further includes a switch, and the controller circuit is further configured to operate the switch to bias a cathode of the first diode to change the operational state.

7. The mass spectrometer of claim 6, wherein the controller is further configured to determine a bleed down time representative of a time for adjusting the first RF signal from the first amplitude to the second amplitude, and configured to operate the switch to bias the cathode of the first diode for the bleed down time.

8. The mass spectrometer of claim 1, wherein the first resonant inductor and the first amplitude control inductor are air core coils.

9. The mass spectrometer of claim 1, wherein the first amplitude control inductor includes one or more coils that are wound around coils of the first resonant inductor.

10. The mass spectrometer of claim 1, wherein the resonant circuit is defined by an inductance of the first resonant inductor and a capacitance of the first pair of rods of the quadrupole mass analyzer.

11. The mass spectrometer of claim 1, wherein the first diode is a Schottky diode.

12. An apparatus, comprising:

a quadrupole configured to manipulate ions by generating an oscillating electric field;

a resonant circuit configured to store energy using a first resonant inductor and use the energy to generate a signal applied to the quadrupole to generate the electric field; and an amplitude control circuit configured to transfer energy from the first resonant inductor using a first amplitude control inductor to adjust an amplitude of the signal applied to the quadrupole.

13. The apparatus of claim 12, wherein the amplitude control circuit includes a first diode having an anode coupled with the first amplitude control inductor.

14. The apparatus of claim 13, further comprising:

a controller circuit configured to bias a cathode of the first diode to transfer the energy away from the first resonant inductor to reduce the amplitude of the signal.

15. The apparatus of claim 13, wherein the diode is a Schottky diode.

16. The apparatus of claim 12, wherein the first resonant inductor has a higher inductance than the first amplitude control inductor.

17. A method of operating a mass spectrometer, comprising:

applying a voltage at a cathode of a diode;

applying a radio frequency (RF) signal having a first amplitude to a quadrupole via a resonant circuit having a resonant circuit inductor;

applying a voltage to an anode of the diode via inductive coupling of the resonant circuit and the anode of the diode; and discharging energy from the resonant circuit to adjust the first amplitude of the RF signal applied to the quadrupole to a second amplitude based on the inductive coupling and the voltages applied at the cathode and the anode of the diode.

18. The method of claim 17, further comprising:

determining a bleed down time indicative of a time for adjusting the first amplitude of the RF signal to the second amplitude; and applying the voltage at the cathode of the diode in accordance with the bleed down time.

19. The method of claim 17, wherein discharging the energy from the resonant circuit is based on changing an operational mode of the diode from a non-conductive state to a conductive-state based on the voltages applied to the cathode and the diode.

20. The method of claim 17, wherein the diode is a Schottky diode.

* * * * *